United States Patent [19]

Lanicek et al.

[11] 4,454,811

[45] Jun. 19, 1984

[54] DEVICE FOR AUTOMATIC ENGAGEMENT OF PRINTING SETS UNDER PRESSURE

[75] Inventors: Josef Lanicek, Jirikovice; Josef Rotter, Brno, both of Czechoslovakia

[73] Assignee: ZVS Vyzkumnevyvojovy ustav, koncernova ucelova organizace, Brno, Czechoslovakia

[21] Appl. No.: 491,365

[22] Filed: May 4, 1983

[30] Foreign Application Priority Data

May 4, 1982 [CS] Czechoslovakia ..... 3206-82

[51] Int. Cl.[3] ..... B41F 5/16

[52] U.S. Cl. ..... 101/185; 101/145; 271/186

[58] Field of Search ..... 101/185, 184, 182, 192, 101/145, 248; 271/186

[56] References Cited

U.S. PATENT DOCUMENTS

| | | | |
|---|---|---|---|
| 3,624,359 | 11/1971 | Roote | 101/184 X |
| 3,701,464 | 10/1972 | Crum | 101/248 |
| 4,116,125 | 9/1978 | Forster et al. | 101/184 |
| 4,264,957 | 4/1981 | Pautzke | 101/248 X |
| 4,385,756 | 5/1983 | Beery | 271/186 |

*Primary Examiner*—E. H. Eickholt

[57] ABSTRACT

The present invention relates to printing machines with paper reversers.

The purpose of the invention is to mitigate the necessity of adjusting or checking the correct position of paper in the paper reverser.

The above purpose is achieved by the present invention where a paper feeding scanner, together with a scanner for checking the angle of displacement of the machine cylinders are connected, via a first coincidence gate, to the input of a first memory. The output of the first memory is connected to the serial input of a first shift register. To the clock pulse input of the first shift register is connected a pulse scanner for scanning pulses which are synchronous with the revolutions of the printing machine parts upstream of the paper reverser. To the first used storage location of the first shift register is connected a first circuit for engaging printing sets under pressure. The second used storage locations of the first shift register, which coincide with the position of the paper reverser within the system of the printing machine printing sets and transfer drums are connected to the serial input of a second shift register. The clock pulse input of the second shift register is connected to a pulse sensor for sensing pulses synchronous with the revolutions of the machine parts downstream of the paper reverser. To the storage locations of the second shift register, which correspond to the number of revolutions since the inlet of the paper sheet, a second circuit for engaging the printing sets under pressure is connected.

2 Claims, 1 Drawing Figure

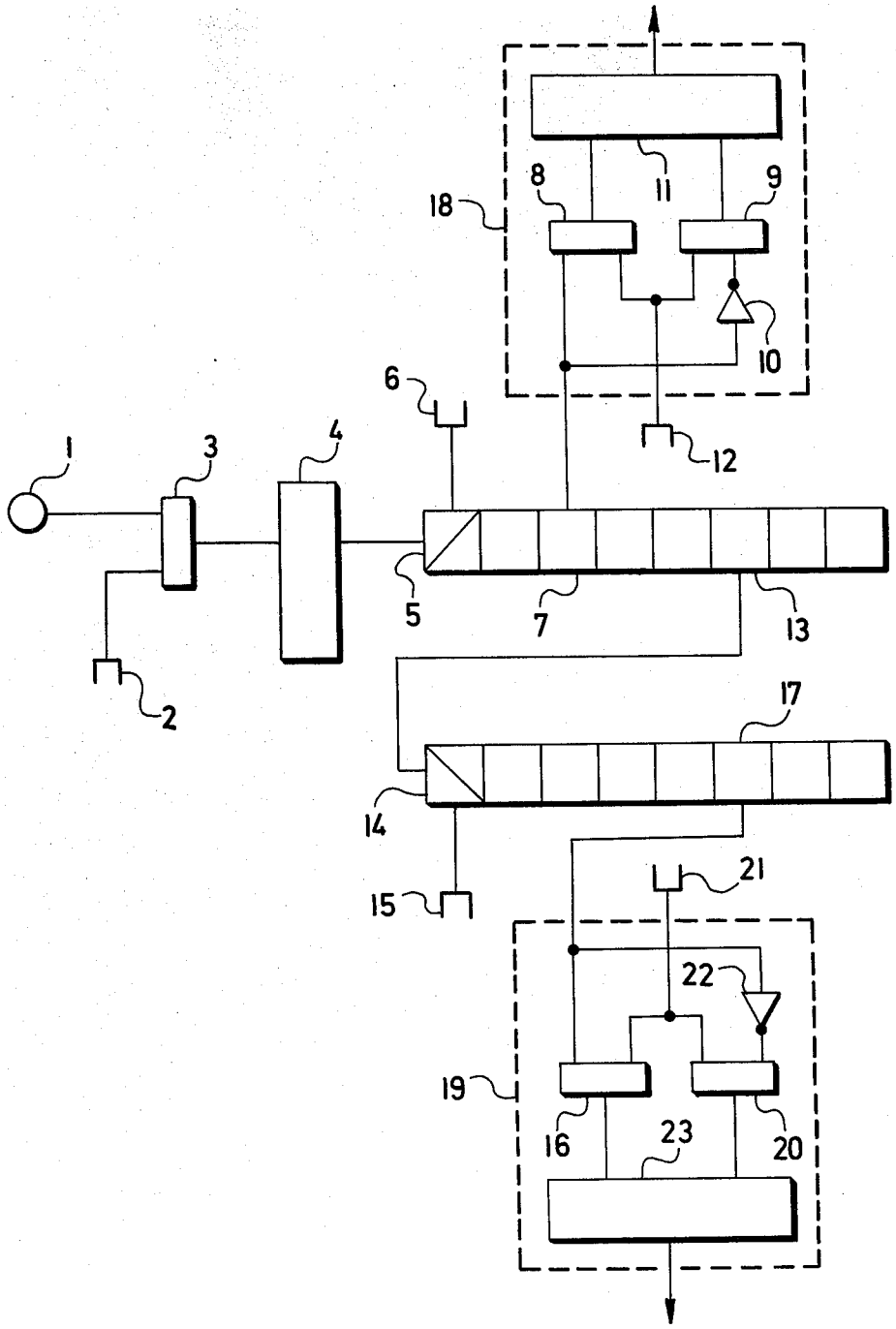
1
2
3
4
5
6
7
8
9
10
11
12
13
14
15
16
17
18
19
20
21
22
23

DEVICE FOR AUTOMATIC ENGAGEMENT OF PRINTING SETS UNDER PRESSURE

BACKGROUND OF THE INVENTION

The present invention relates to a device for automatic engagement of printing sets under pressure in printing machines with paper reversers.

In printing machines, the automatic engagement of impression pressure on the separate printing sets can be controlled depending on the paper transfer by the machine. The printing machine can be provided with a paper reverser, which makes it possible to print on both sides of the sheet. Moreover, it is necessary that the mechanism for engaging the printing sets under pressure be synchronized with the paper reverser without any intervention of the operator.

For the automatic engagement of printing sets under pressure, various relay or electronic circuits are used. However, it is necessary to distribute about the printing machine paper presence scanners or swivelling stage scanners for paper reversers.

The disadvantage of the circuits hitherto used is the necessity of arranging paper presence scanners about the machine, particularly on the paper reverser where it is necessary to check the correct position of the paper after it is handled by the paper reverser.

The above disadvantages are mitigated by the present invention where the paper feeding scanner, together with the scanner for checking the angle of displacement of the machine cylinders are connected, via a first coincidence gate, to the input of the first memory. The output of the first memory is connected to the serial input of the first shift register. To the clock pulse input of the first shift register is connected a pulse scanner for scanning pulses which are synchronous with the revolutions of the printing machine parts upstream of the paper reverser. To the first storage location of the first shift register is connected the first circuit for engaging printing sets under pressure. The other storage locations of the first shift register, which coincide with the position of the paper reverser within the system of the printing machine printing sets and transfer drums, are connected to the serial input of the second shift register. The clock pulse input of the second shift register is connected to a pulse sensor for sensing pulses synchronous with the revolutions of the machine parts downstream of the paper reverser. To the storage locations of the second shift register, which correspond to the number of revolutions since the inlet of the paper sheet, a second circuit for engaging the printing sets under pressure is connected.

The present invention makes possible that, upon handling of paper by the paper reverser, the operator need not perform any readjustment or checking.

BRIEF DESCRIPTION OF THE DRAWING

An embodiment in form of an example of the present invention i.e. the device for automatically engaging printing sets under pressure, is shown in the accompanying drawing by means of a block diagram.

DETAILED DESCRIPTION

To the inputs of the first coincidence gate 3, paper feeding scanner 1 and the scanner 2 for scanning the checking angle of displacement of the machine cylinders are connected. The output of the first coincidence gate 3 is connected to the input of the first memory 4.

The output of the first memory 4 is connected to the serial input of the first shift register 5. According to need, a plurality of the said first shift registers 5 can be used. To the clock pulse input of the first shift register 5, the pulse sensor 6 for sensing pulses synchronous with the revolutions of the machine parts upstream of the paper reverser is connected. The first used storage location 7 of the first shift register 5 is connected to the first circuit 18 for engaging printing sets under pressure. The second used storage location 13 of the first shift register 5, which coincides with the position of the paper reverser in the system of printing sets of the machine, are connected to the serial input of the second shift register 14. To the clock pulse input of the second shift register 14, the pulse sensor 15 for sensing pulses synchronous with the revolutions of the machine parts downstream of the paper reverser is connected. To the storage location 17 of the second shift register 14, which coincides with the number of revolutions of such downstream machine parts after the feeding of the paper sheet into the paper reverser, the second circuit 19 for commanding the engagement of the printing sets under pressure is connected. The second shift register 14 can be a single one, or a string of such registers can be used.

the first circuit 18 for commanding the engagement of printing sets under pressure includes a second coincidence gate 8, of which the first input is the input of the first circuit 18 for engaging printing sets under pressure, which is also connected via the first inverter 10 to the second input of a third coincidence gate 9. The second input of the second coincidence gate 8 is connected to the first input of the third coincidence gate 9 and scanner 12 of the angle of displacement of the single revolution shaft of the machine part upstream of the paper reverser. The output of the second coincidence gate 8 is connected to the "input of adjustment" of a first output memory 11, while the output of the third coincidence gate 9 is connected to the clearing input of the first output memory 11, of which the output is connected to the mechanism for engaging printing sets under pressure upstream of the paper reverser.

The second circuit 19 for engaging printing sets under pressure includes a fourth coincidence gate 16, of which the first input is the input of the second circuit 19 for engaging printing sets under pressure, which is also connected via a second inverter 22, to the second input of a fifth coincidence gate 20. The second input of the fourth coincidence gate 16 is connected to the first input of the fifth coincidence gate 20 and scanner 21 of the angle of displacement of the single revolution shaft of the machine part downstream of the paper reverser. The output of the fourth coincidence gate 16 is connected to the "input of adjustment" of a second output memory 23 and the output of the fifth coincidence gate 20 is connected to the clearing input of the second output memory 23, of which the output is connected to the mechanism for engaging the printing sets under pressure downstream of the paper reverser.

MANNER OF OPERATION

The device, according to the present invention, operates as follows:

The output of the first coincidence gate 3 drives, according to signals from the paper feeding scanner 1 and the scanner 2 for scanning the checking angle of displacement of the machine cylinders, first memory 4, from which a pulse is sent to the serial input of the first shift register 5. The first circuit 18 for engaging printing sets under pressure is controlled in such manner, that when at the first storage location 7 of the first shift register 5, value "1" appears as the angle which is determined by scanner 12 of the angle of displacement of the single revolution shaft of the machine part upstream of the paper reverser, said value is directed to the "adjustment input" of the first output memory 11, which is transferred and closes by its output signal the mechanism for engaging under pressure the printing sets upstream of the paper reverser. However, if at the first storage location 7 of the first shift register 5 value "0" appears as the angle determined by scanner 12 of the angle of displacement of the single revolution shaft of the machine part upstream of the paper reverser, this value is directed to the clearing input of the first output memory 11, which is transferred and which disengages by its output signal the mechanism for engaging printing sets under pressure.

Pulse scanner 15 scans pulses synchronous with the revolutions of the angle revolution shaft of the machine part downstream of the paper reverser. Thus, the storage locations of the second shift register 14 follow the angle of displacement of the printing machine part downstream of the paper reverser, without the necessity of adjusting any of the scanners, upon handling of the paper by the paper reverser.

The engagement of the printing sets under pressure downstream of the paper reverser is controlled by the second circuit 19 for engaging printing sets under pressure, said circuit operating in an analogous manner, as specified for the first circuit 18 for engaging printing sets under pressure.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. In a printing machine having printing cylinders and provided with a paper reverser having transfer drums, the improvement comprising a mechanism for automatically checking the correct position of the paper upon the handling of the paper by the paper reverser, said mechanism comprising a first, paper feeding scanner, a second scanner for checking the angle of displacement of the printing cylinders and the transfer drums, circuit means for connecting the first and second scanners via a first coincidence gate to the input of a first memory, a first shift register having a serial input and a clock pulse input, the output of said first memory being connected to the serial input of said first shift register, to the clock pulse input of said first shift register there is connected a scanner of pulses which are in synchronism with the rotation of a transfer drum upstream of the paper reverser, a first circuit for commanding the printing of the first side of a sheet of paper with a first printing set, said first circuit being connected to the first used storage location of the first shift register, the second used storage location of the first shift register coinciding with the position of the paper reverser within the system of printing sets of the printing machine and the transfer drums, a second shift register having a serial input and a clock pulse input, the clock pulse input of the shift second register being connected to a second pulse scanner for detecting pulses synchronous with the revolution of a printing machine part downstream of the paper reverser, and a second circuit for commanding the printing of the second side of the sheet of paper with a second printing set, said second circuit being connected to the storage location of the second shift register which coincides with the number of revolutions of such downstream machine part after the feeding of the paper sheet into the paper reverser.

2. A mechanism as claimed in claim 1, wherein the first circuit for commanding the engagement of printing sets under pressure comprises a second coincidence gate of which the first input is the input of the first circuit for engaging printing sets under pressure, and which is connected via a first inverter, to the second input of the third coincidence gate, the second input of the second coincidence gate is connected to the first input of the third coincidence gate, while the second input of a second coincidence gate is connected to the first input of the third coincidence gate and the scanner of the angle of displacement of the single revolution shaft upstream of the paper reverser, the output of the second coincidence gate is connected with the "input of adjustment" the first output memory, and the output of the third coincidence gate is connected to the clearing input of the first output memory, while the output thereof is connected to the mechanism of imparting impression pressure upstream of the paper reverser, the second circuit of engaging printing sets under pressure comprising a fourth coincidence gate, of which the first input is the input of the second circuit for engaging printing sets under pressure and is connected, via a second inverter to the second input of a fifth coincidence gate, the second input of the fourth coincidence gate is connected to the first input of the fifth coincidence gate and to the scanner of the angle of displacement of the single revolution shaft downstream of the paper reverser, the output of the fourth coincidence gate being connected to the "input of adjustment" of the second output memory, and the output of the fifth coincidence gate is connected to the clearing input of the second output memory, of which the output is connected to the mechanism of imparting impression pressure downstream of the paper reverser.

* * * * *